US008702287B2

(12) United States Patent
Ohno

(10) Patent No.: US 8,702,287 B2
(45) Date of Patent: Apr. 22, 2014

(54) LIGHTING FIXTURE

(75) Inventor: Masafumi Ohno, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 13/412,579

(22) Filed: Mar. 5, 2012

(65) Prior Publication Data

US 2012/0176809 A1 Jul. 12, 2012

Related U.S. Application Data

(63) Continuation of application No. PCT/JP2010/064487, filed on Aug. 26, 2010.

(30) Foreign Application Priority Data

Sep. 4, 2009 (JP) ..... 2009-204822

(51) Int. Cl.
*F21V 7/00* (2006.01)
*F21V 5/00* (2006.01)
*F21V 3/00* (2006.01)

(52) U.S. Cl.
USPC ..... 362/516; 362/520; 362/311.02; 362/299; 362/327; 362/311.03

(58) Field of Classification Search
USPC ..... 362/516, 518, 519, 520, 311.02, 297, 362/299, 300, 296.05, 311.03, 311.04, 327
See application file for complete search history.

(56) References Cited

U.S. PATENT DOCUMENTS 3,818,210 A * 6/1974 Pitkjaan ..... 362/518
5,307,247 A * 4/1994 Cejnek ..... 362/539
6,811,289 B2 * 11/2004 Nakata ..... 362/516
6,997,565 B2 * 2/2006 Sekiguchi et al. ..... 353/102
7,097,334 B2 * 8/2006 Ishida et al. ..... 362/516

(Continued)

FOREIGN PATENT DOCUMENTS

CN 2045813 U 10/1989
JP 6-50107 U 7/1994

(Continued)

OTHER PUBLICATIONS

International Preliminary Report on Patentability for related PCT Application No. PCT/JP2010/064487 dated Mar. 6, 2012. ISR report date is Apr. 11, 2012.

(Continued)

*Primary Examiner* — Jong-Suk (James) Lee
*Assistant Examiner* — Bryon T Gyllstrom
(74) *Attorney, Agent, or Firm* — Kenealy Vaidya LLP

(57) ABSTRACT

A lighting fixture can include a light source, and a lens body including an incident face through which light emitted from the light source enters the lens body, an exit face, and a reflecting face configured to reflect light which has entered the lens body from the incident face such that the reflected light is emitted from the exit face to form a predetermined light distribution pattern having a boundary line between light and dark. The reflecting face can include a first reflecting region configured to reflect light with a reference wavelength which has entered the incident face perpendicularly with respect to the incident face. A second reflecting region can be configured to reflect light with a wavelength longer than the reference wavelength. A third reflecting region can be configured to reflect light with a wavelength shorter than the reference wavelength.

14 Claims, 8 Drawing Sheets

(56) References Cited

U.S. PATENT DOCUMENTS

| | | | | |
|---|---|---|---|---|
| 7,207,705 | B2 * | 4/2007 | Ishida | 362/517 |
| 7,306,352 | B2 * | 12/2007 | Sokolov et al. | 362/341 |
| 7,312,477 | B2 * | 12/2007 | Yatsuda et al. | 257/98 |
| 7,419,289 | B2 * | 9/2008 | Yagi | 362/523 |
| 2005/0180158 | A1 | 8/2005 | Komatsu | |
| 2006/0087860 | A1 * | 4/2006 | Ishida | 362/517 |
| 2006/0285347 | A1 | 12/2006 | Okada | |
| 2008/0212336 | A1 * | 9/2008 | Chae | 362/547 |

FOREIGN PATENT DOCUMENTS

| | | | |
|---|---|---|---|
| JP | 2005-228502 | A | 8/2005 |
| JP | 2006-324013 | A | 11/2006 |
| JP | 2007-250233 | A | 9/2007 |
| JP | 2008-78086 | A | 4/2008 |

OTHER PUBLICATIONS

International Search Report for PCT/JP2010/064487 dated Nov. 22, 2010.

The Chinese Office Action for the related Chinese Patent Application No. 201080039228.1 dated Jun. 20, 2013.

National Standards of the People's Republic of China GB 4599-94, Photometric characteristics of headlamps for motor vehicles, China State Bureau of Technical Supervision, Sep. 28, 1994.

* cited by examiner

RELATED ART

LIGHTING FIXTURE

This application is a PCT Bypass continuation application and claims the priority benefit under 35 U.S.C. §120 of PCT Application No. PCT/JP2010/064487 filed on Aug. 26, 2010 which application designates the U.S., and also claims the priority benefit under 35 U.S.C. §119 of Japanese Patent Applications No. 2009-204822 filed on Sep. 4, 2009, which applications are all hereby incorporated in their entireties by reference.

TECHNICAL FIELD

The presently disclosed subject matter relates to a lighting fixture, and in particular to a lighting fixture for a vehicle which uses a light source, such as a light emitting diode (LED), and controls light distribution of light from the LED light source by an optical system using a light guide (a lens body having a reflecting face for internally reflecting light from the LED light source), for example, thereby emitting illumination light for forming a light distribution pattern for a passing beam (a low beam).

BACKGROUND ART

A lighting fixture for a vehicle which uses a light emitting diode (LED) as a light source and performs light distribution of light of an LED using a light guide is disclosed in Patent Literature 1 (referenced below). FIG. 7 is a vertical-sectional view of a configuration of the lighting fixture for a vehicle. As illustrated in FIG. 7, a light emitting element 100*a* of a light source 100 is disposed upwardly with respect to a vehicle, and a light guide 102 is disposed above the light source 100. The light guide 102 is composed of an incident face 104 which is positioned on a lower side of a vehicle and through which light from the light source 100 advances inside the light guide 102, a reflecting face 106 which is positioned on a more rearward side of the vehicle and which reflects light advanced inside through the incident face 104 forward of the vehicle, and an exit face 108 which is positioned on a more frontward side of the vehicle and which emits light reflected by the reflecting face outside the light guide 102.

PATENT LITERATURE

PTL 1: Japanese Patent Application Laid-Open No. 2008-78086

SUMMARY

In Patent Literature 1, when acrylic was used as a transparent resin instead of a light guide made of glass, in order to reduce the weight of a headlamp, color smear became significant at a boundary of a light distribution pattern. Further, when polycarbonate with heat resistance higher than that of the acrylic was used as a resin material, a problem of a color smear at a boundary of a light distribution pattern appeared more significantly. Even when the light source is an LED, a temperature within a lamp body can become relatively high, so it is necessary to mold the light guide of a transparent resin with a high heat resistance such as a polycarbonate material. However, the polycarbonate material changes in refraction index largely according to wavelength of light as compared with other transparent resin materials, and the polycarbonate material has a large chromatic dispersion. Here, the chromatic dispersion means dispersion of light, and indicates a phenomenon where, when light enters a lens or a prism, the refraction index of the light changes according to the wavelength of the light.

Therefore, when a polycarbonate material having a large chromatic dispersion is used in a light guide forming a predetermined light distribution pattern, as described above, a chromatic aberration occurring at a boundary between light and dark which is an upper end edge of the light distribution pattern also becomes larger. A blue or red band-shaped illumination region appears on the upper side of the boundary between light and dark, and a color separation is observed. The color separation appears at a boundary between light and dark of the light distribution pattern due to the light guide, which blocks evenness of the light distribution pattern. Therefore, there is such a possibility that requirements of regulations required as a headlamp are not satisfied. The problem of occurrence of such an unintended illumination region (color separation) is not limited to the case where the light guide is molded of a polycarbonate material, and similarly occurs to various degrees even in the case where the light guide is molded of another transparent material (glass, acrylic, or the like).

The presently disclosed subject matter has been made in view of these circumstances. According to one aspect of the presently disclosed subject matter a lighting fixture for a vehicle can be configured to reduce drawbacks that may occur when an unintended illumination region occurs on an upper side of a boundary between light and dark of a light distribution pattern due to chromatic dispersion when light is emitted in a direction of the boundary between light and dark by an optical system using a light guide (a lens body having a reflecting face which performs internal reflection).

In accordance with another aspect of the disclosed subject matter, a lighting fixture for a vehicle according to a first aspect of the presently disclosed subject matter is a lighting fixture for a vehicle for emitting light used for formation of a partial light distribution pattern constituting a light distribution pattern for a predetermined white low beam, which includes a light source configured to emit visible light having a plurality of wavelength components; and a solid lens body which includes an incident face through which light emitted from the light source enters the lens body, an exit face, and a reflecting face configured to internally reflect light which has entered the lens body through the incident face such that the internally-reflected light is emitted from the exit face to form a predetermined light distribution pattern having a boundary line between light and dark, wherein the reflecting face includes: a first reflecting region configured to internally reflect light with a reference wavelength which has been emitted from an end portion of the light source, the end portion corresponding to the boundary line between light and dark, to enter the incident face perpendicularly to the incident face and has entered the lens body without being refracted such that the reflected light is emitted from the exit face to form the boundary line between light and dark; a second reflecting region configured to internally reflect light with a wavelength longer than the reference wavelength which has been emitted from the end portion of the light source, the end portion corresponding to the boundary line between light and dark, to enter the incident face at an angle other than the perpendicular angle to the incident face and has been refracted in response to the entering angle to enter the lens body such that the reflected light is distributed on or below the boundary line between light and dark when the reflected light has been emitted from the exit face; and a third reflecting region configured to internally reflect light with a wavelength shorter than the reference wavelength which has been emitted from the end portion of the light source, the end portion corresponding to the boundary line between light and dark, to enter the incident face at an angle other than the perpendicular angle to the incident face and has been refracted in response to the entering angle to enter the lens body such that the reflected light is distributed on or below the boundary line between light and dark when the reflected light has been emitted from the exit face.

A lighting fixture for a vehicle according to a second aspect of the presently disclosed subject matter is a lighting fixture for a vehicle including: a light source configured to emit visible light having a plurality of wavelength components; and a lens body having an incident face, a reflecting face, and an exit face, the lens body reflecting light from the light source which has passed through the incident face to enter the lens body in a predetermined direction by the reflecting face to emit the light from the exit face outside the lens body, wherein the shapes of the incident face, the reflecting face, and the exit face are configured such that light with a green wavelength which is contained in light in a visible light range which has been emitted from an end portion of the light source to enter the incident face is emitted from the exit face in a direction of a boundary line between light and dark of a predetermined light distribution pattern, and are configured such that light, which is reflected at a substantially central position of the reflecting face in a vertical direction of the reflecting face, of the light with a green wavelength emitted from the exit face in the direction of the boundary line between light and dark passes through a non-refraction optical path where refraction does not occur on the incident face and the exit face and lights which are reflected at an upper side position and a lower side position of the reflecting face above or below the light of the non-refraction optical path pass through a refraction optical path where refraction occurs on the incident face or the exit face; and at least one face of the incident face, the reflecting face, and the exit face of the lens body has a shape corrected such that the light with a green wavelength component which passes through the refraction optical path is distributed below the direction of the boundary line between light and dark in such a manner that light, which has a wavelength component other than the green wavelength component which has been subjected to chromatic dispersion by refraction, of the light passing through the refraction optical path is not distributed above the boundary line between light and dark.

In general, at the time of an optical design of a lighting fixture for a vehicle, a refraction index to light with a green wavelength is used as a refraction index of a lens body. Thereby, when a design is such that light is emitted in a direction of a boundary line between light and dark of a light distribution pattern, shapes of an incident face, a reflecting face, and an exit face of the lens body are formed such that a light beam with a green wavelength contained in a light beam (a white light beam) with a wavelength falling in a visible range emitted from a predetermined point in a light source is emitted in a direction of the boundary line between light and dark. The presently disclosed subject matter corrects shapes of an incident face, a reflecting face, and an exit face of such a lens body to emit a light beam with a green wavelength which has passed through the refraction optical path where chromatic dispersion occurs in a more downward direction than the direction of the boundary line between light and dark. Thereby, drawbacks associated with the green wavelength can be prevented from occurring that a light beam other than the light beam with a green wavelength, which has occurred due to chromatic dispersion faces in a more upward direction than the direction of the boundary line between light and dark, so that such a drawback can be prevented, such as when an unintended illumination region occurs on an upper side of the boundary line between light and dark.

Further, by setting the position of the reflecting face from which a light beam of the non-refraction optical path where chromatic dispersion does not occur is reflected at a substantially central position on the reflecting face in a vertical direction of the reflecting face, chromatic dispersion occurring in the refraction optical path can be made small wholly and generation of an unintended illumination region itself occurring on an upper side of the boundary line between light and dark can be reduced, as compared with the case where the position of the reflecting face from which a light beam of the non-refraction optical path is reflected is positioned on an upper end side or a lower end side of the reflecting face. Further, in the case where the shape of one face of the incident face, the reflecting face, and the exit face is corrected such that a light beam with a green wavelength passing through the refraction optical path is oriented in a more downward direction than in the direction of the boundary line between light and dark, magnitude of the correction can be reduced.

A lighting fixture for a vehicle according to a third aspect of the presently disclosed subject matter is the lighting fixture for a vehicle in the first or second aspect where the incident face is a concave curved face constituting an arc or an elliptic arc configured such that a sectional shape thereof has the center at a position separated from the end portion of the light source.

According to the aspect, by forming the incident face from the concave curved face, an incident angle of the light beam which enters the incident face from the LED light source and a chromatic dispersion occurring due to refraction on the incident face can be made smaller, so that such a drawback can be prevented, such as when an unintended illumination region is generated on an upper side of the boundary line between light and dark.

A lighting fixture for a vehicle according to a fourth aspect of the presently disclosed subject matter is a lighting fixture for a vehicle including: a light source configured to emit visible light having a plurality of wavelength components; and a lens body having an incident face, a reflecting face, and an exit face, the lens body being configured such that a light distribution pattern formed by reflecting light from the light source which has entered the lens body from the incident face in a predetermined direction by the reflecting face to emit the light outside the lens body forms a boundary line between light and dark, wherein the incident face is formed as a flat face and/or a concave curved face forming a non-refraction optical path where light emitted from an end portion of the light source to enter the incident face does not cause refraction on the incident face and a refraction optical path where light emitted from the end portion of the light source to enter the incident face causes refraction on the incident face; the reflecting face includes a non-refraction optical path reflecting portion where light passing through the non-refraction optical path is reflected, a refraction optical path reflecting portion where light passing through the refraction optical path is reflected, and an upper side refraction optical path reflecting portion positioned on a portion of the reflecting face positioned on an upper side of a vehicle than the non-refraction optical path reflecting portion in a vertical section of the lens body; and the upper side refraction optical path reflecting portion is formed such that, when it is assumed that light emitted from the light source is green, the light passing through the non-refraction optical path is oriented slightly downward relative to light emitted outside the lens body, and when it is assumed that the light emitted from the light source has a visible light color having a refraction index smaller than the refraction index of the green wavelength in the lens body, the upper side refraction optical path reflecting portion performs emission toward a boundary line between light and dark of a light distribution pattern constituted by the light passing through the non-refraction optical path to be emitted outside the lens body or inward of the light distribution pattern.

The problem of the unintended illumination region on the upper side of the boundary line between light and dark becomes significant regarding a light beam reflected by the upper side refraction optical path reflecting portion positioned above the non-refraction optical path reflecting portion. According to this aspect, the upper side refraction optical path reflecting portion is formed such that a visible light beam with a wavelength having a refraction index smaller than that of a green wavelength, of a light beam reflected by the upper side refraction optical path reflecting portion to be emitted outside the lens body is emitted in a more upward direction than the light beam with a green wavelength, and a visible light beam emitted in a more upward direction than the direction of the light beam with a green wavelength is emitted on the boundary line between light and dark of the light distribution pattern or inward of the light distribution pattern. Therefore, such a drawback can be prevented, such as when an unintended illumination region occurs on the upper side of the boundary line between light and dark.

A lighting fixture for a vehicle according to a fifth aspect of the presently disclosed subject matter is the lighting fixture for a vehicle in the fourth aspect where the reflecting face is further provided with a lower side refraction optical path reflecting portion positioned on a portion of the reflecting face positioned on a lower side of the vehicle than the non-refraction optical path reflecting portion in the vertical section of the lens body, and the lower side refraction optical path reflecting portion is formed such that when it is assumed that light emitted from the light source is green, light passing through the non-refraction optical path is oriented slightly downward relative to light emitted outside the lens body, and when light emitted from the light source is a visible light color with a refraction index larger than that of the light with a green wavelength component in the lens body, the light passing through the non-refraction optical path to be emitted outside the lens body is emitted toward the boundary line between light and dark of a light distribution pattern, or inward of the light distribution pattern.

According to this aspect, the lower side refraction optical path reflecting portion is formed such that, when the lower side refraction optical path reflecting portion positioned below the non-refraction optical path reflecting portion is provided, a light beam of a visible light color with a refraction index larger than that of a green wavelength, of a light beam reflected by the lower side refraction optical path reflecting portion to be emitted outside the lens body is emitted more upward than the light beam having a green wavelength, and a light beam of a visible light color emitted more upward than the light beam of a green wavelength is emitted on the boundary line between light and dark of the light distribution pattern or inwardly of the light distribution pattern. Therefore, such a drawback can be prevented, such as when an unintended illumination region occurs on the upper side of the boundary line between light and dark. Further, since the non-refraction optical path reflecting portion is formed near a central portion of the reflecting face in the vertical direction of the reflecting face to be sandwiched between the upper side refraction optical path reflecting portion and the lower side refraction optical path reflecting portion, chromatic dispersion occurring in the refraction optical path can be made wholly smaller than the case where the non-refraction optical path reflecting portion is set to be positioned at an upper end or a lower end of the reflecting face, and occurrence of an unintended illumination region occurring on the upper side of the boundary line between light and dark itself can be reduced.

A lighting fixture for a vehicle according to a sixth aspect of the presently disclosed subject matter is the lighting fixture for a vehicle in the second or fourth aspect where the lens body includes a second reflecting face different from the reflecting face, and the second reflecting face is provided in an optical path where light which has entered from the incident face advances in the lens body to reach the reflecting face.

By providing a plurality of reflecting faces in the lens body like this aspect, a width of a place where the light source is arranged can be expanded.

A lighting fixture for a vehicle according to a seventh aspect of the presently disclosed subject matter is the lighting fixture for a vehicle in any one of the first to sixth aspect where the light source is configured by an LED light source containing a light emitting diode element and a wavelength-converting material.

This aspect illustrates an aspect where the light emitting diode and the wavelength-converting material are used in the light source in order to achieve size reduction and electric power saving of the lighting fixture for a vehicle.

A lighting fixture for a vehicle according to an eighth aspect of the presently disclosed subject matter is the lighting fixture for a vehicle in any one of the first to seventh aspect where the lens body is formed of a polycarbonate material. Since the polycarbonate material is a transparent resin having a high heat resistance, the polycarbonate material is suitable as a material of the lens body which is put in situations in which the temperature within a lamp body reaches a high temperature. On the other hand, since the polycarbonate material is large in chromatic dispersion, there is a high possibility that an unintended illumination region occurs on the upper side of the boundary line between light and dark due to the chromatic dispersion, but when the polycarbonate material is used in the lens body of the lighting fixture for a vehicle configured like the above first to seventh aspects, occurrence of such an unintended illumination region is prevented, so that the polycarbonate material can be used as a material of the lens body without causing such a drawback.

According to the presently disclosed subject matter, when a light distribution pattern having a boundary between light and dark is formed by an optical system using a light guide, a drawback can be prevented in which an unintended illumination region due to chromatic dispersion is generated on the upper side of a boundary line between light and dark.

Further, according to the presently disclosed subject matter, since a drawback which is caused by chromatic dispersion due to a difference in refraction index between wavelengths can be prevented, such a drawback that an unintended illumination region is generated on the upper side of a boundary between light and dark when a refraction index varies according to a temperature or when a material of the lens body has a property of birefringence can also be reduced.

DESCRIPTION OF EXEMPLARY EMBODIMENTS

Exemplary embodiments for implementing a lighting fixture according to the presently disclosed subject matter will be described in detail with reference to the accompanying drawings.

Figure 1:
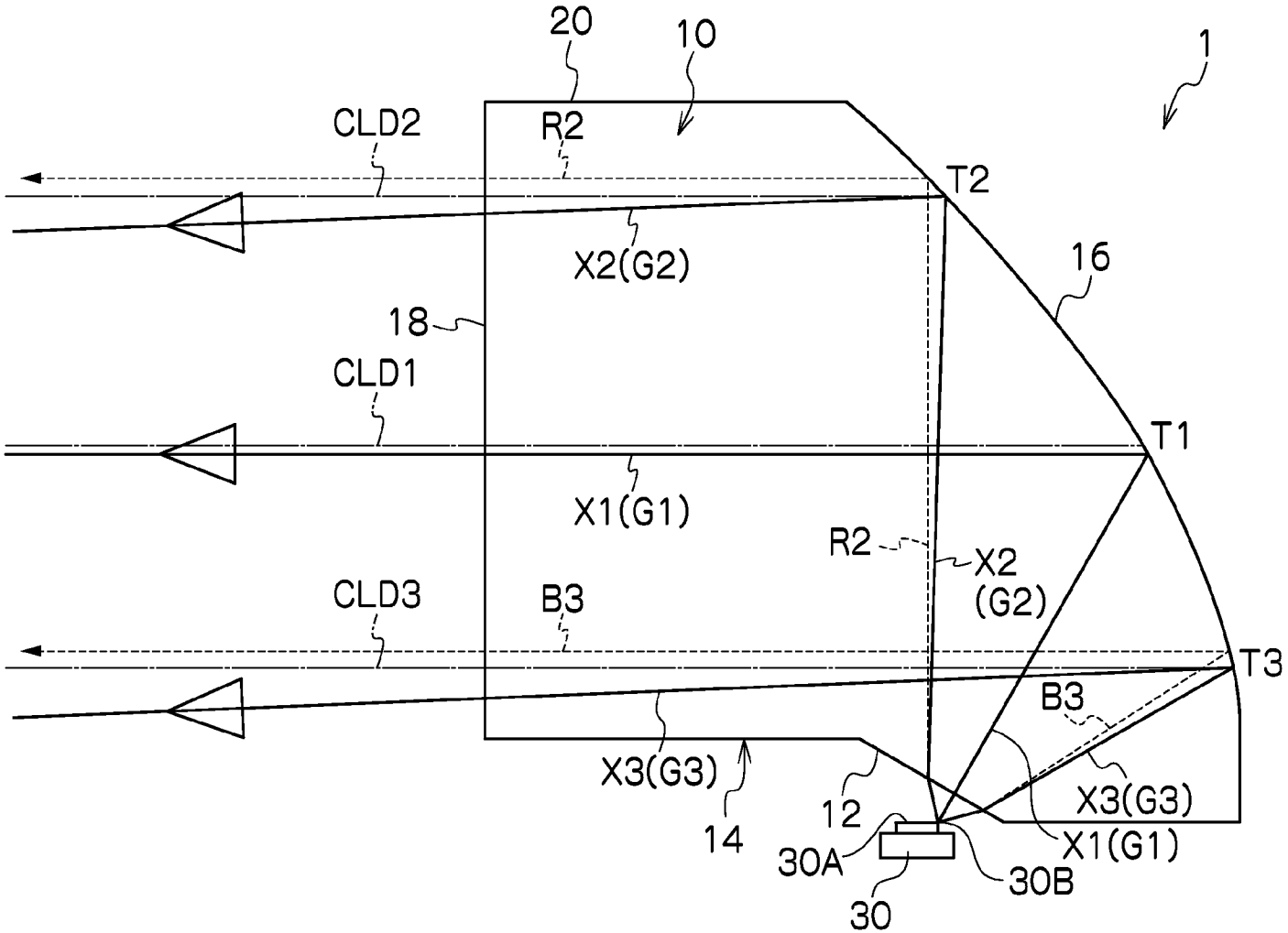
FIG. 1 is a vertical-sectional view illustrating a configuration of a first embodiment of a lighting fixture for a vehicle according to principles of the presently disclosed subject matter.

FIG. 1 is a vertical-sectional view illustrating a configuration of a first embodiment of a lighting fixture for a vehicle according to the presently disclosed subject matter. A lighting fixture 1 for a vehicle illustrated in FIG. 1 is applied to, for example, a headlamp performing irradiation of an illumination light having a light distribution pattern for a passing beam (low beam) in an automobile, an automatic bicycle or the like, and includes a lens body 10 (light guide) injection-molded with a polycarbonate material which is a transparent resin with a high heat resistance and an LED light source 30.

The lens body 10 is formed in, for example, a three-dimensional shape enclosed by a bottom face 14 including an incident face 12, a reflecting face 16 arranged on a rear side of a vehicle (a rear side of a lighting fixture), an exit face 18 arranged on a front side of the vehicle, an upper face 20 arranged on an upper side of the vehicle, and two lateral faces (not illustrated) arranged on both lateral sides of the vehicle.

The incident face 12 is an incident face through which light emitted from the LED light source 30 enters the lens body 10, and is formed of a flat face inclined relative to a horizontal direction (in a longitudinal direction of the vehicle). Other faces constituting the bottom face 14 are composed of horizontal flat faces.

The reflecting face 16 reflects light which is emitted from the LED light source 30 to pass through the incident face 12 and to enter the lens body 10 in a predetermined direction. The reflecting face 16 is formed, for example, based upon the shape of a paraboloid of revolution type. The reflecting face 16 may be configured to totally reflect the incident light on an inner face thereof, or may be configured such that a reflecting film of a metal such as aluminum is formed on an outer face of the reflecting face 16 in a portion where the incident light is not totally reflected or the like so that the incident light is reflected by the reflecting film.

The exit face 18 is a face through which the reflected light from the reflecting face 16 is emitted, and is formed of a flat face extending in a vertical direction perpendicular to the longitudinal direction of the vehicle in this embodiment.

Figure 6A:
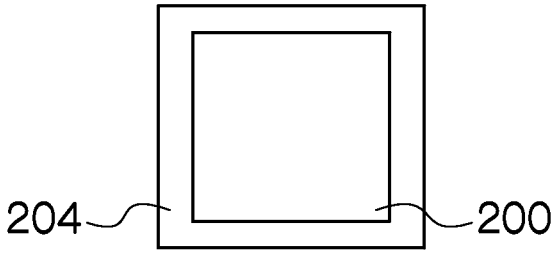
FIG. 6A is a front view illustrating a configuration of an LED light source.
Figure 6B:
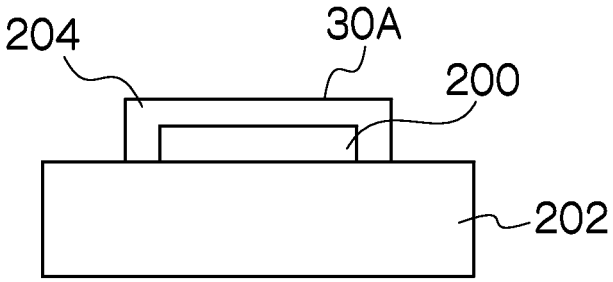
FIG. 6B is a side sectional view illustrating the configuration of the LED light source.
Figure 7:
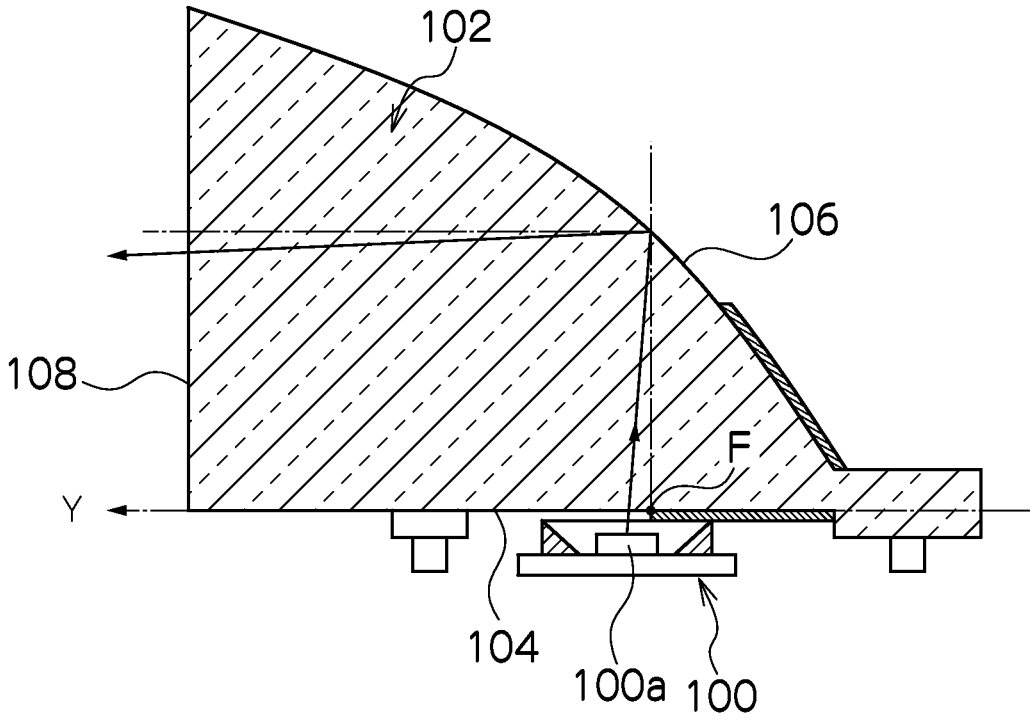
FIG. 7 is a vertical-sectional view illustrating a configuration of a conventional lighting fixture for a vehicle using a light guide.

The LED light source 30 is, for example, a light source obtained by packaging one or a plurality of LED chips to emit white light, where a flat-shaped light emitting face 30A which is configured to emit light and is arranged upward in the substantially vertical direction. For example, an LED chip of InGaN series for emitting blue light is used as the LED chip, and one where a wavelength-converting material layer 204 is provided on a LED chip 200 mounted on a circuit base board 202 in a planer state can be used as the LED chip, as illustrated in FIGS. 6A and 6B. As the wavelength-converting material layer 204, YAG (Yttrium Aluminum Garnet) fluorescence substances dispersed in a silicone resin, or the like, can be used. Thereby, white light obtained by color-mixing blue from the LED chip and yellow (light containing a red component and a green component) wavelength-converted by the YAG fluorescence substances is emitted. Incidentally, the light emitting face 30A is not limited to a flat shape but may be formed in a convex shape.

Figure 2:
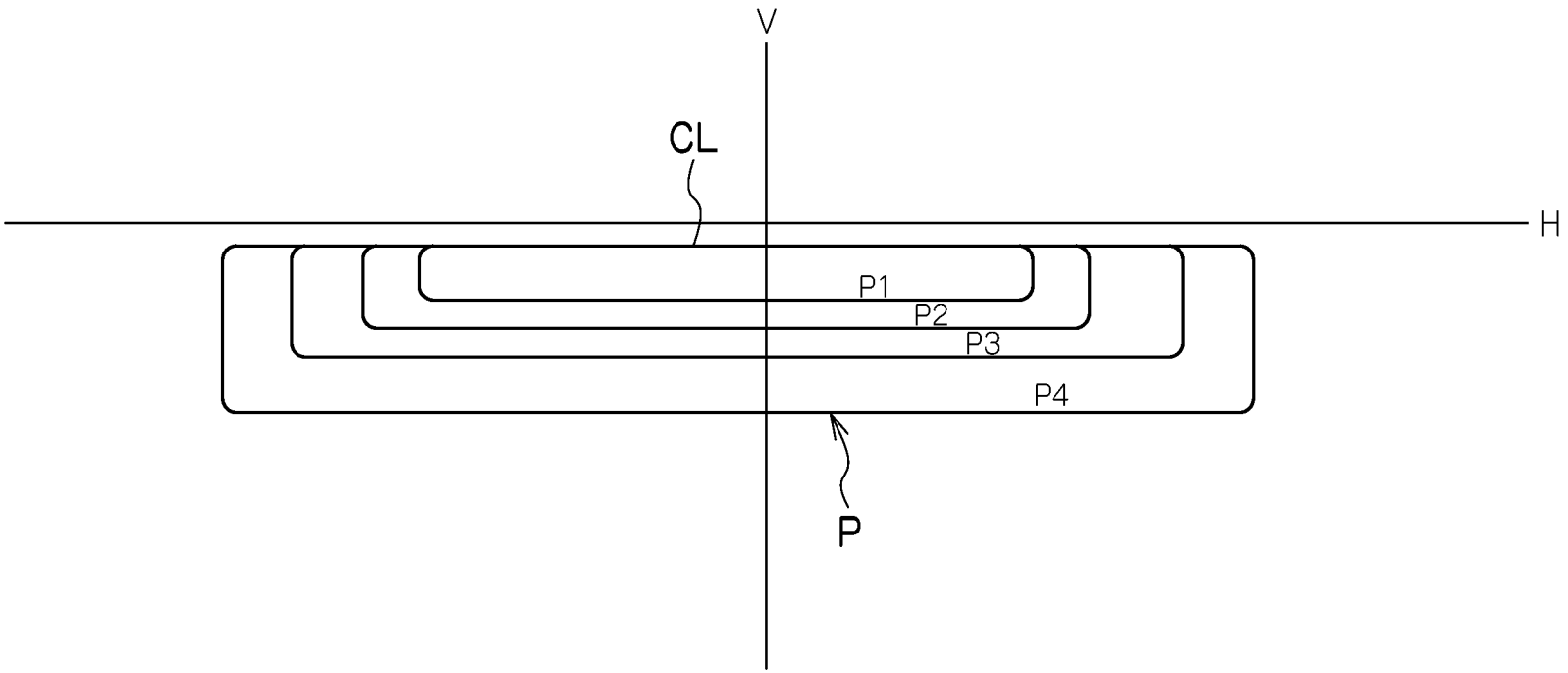
FIG. 2 is a diagram illustrating a light distribution pattern of illumination light emitted by the lighting fixture for a vehicle illustrated in FIG. 1.

The lighting fixture 1 for a vehicle configured as described above is configured to emit light emitted from the LED light source 30 as illumination light with a light distribution pattern for a passing beam such as illustrated in FIG. 2 through the lens body 10. In FIG. 2, an H line illustrating an angle in a horizontal direction to a straightforward direction of the lighting fixture 1 for a vehicle and a V line illustrating an angle in a vertical direction are illustrated. The light distribution pattern illustrated in FIG. 2 includes a light distribution region P (regions P1 to P4 whose light intensity values lower in sequence) where light is emitted so as to be expanded to both left and right sides of the V line within an angle range oriented in a more downward direction than the H line. A boundary line between light and dark (cutoff line) CL representing a boundary between light and dark between a light region on which light is illuminated and a dark region on which light is not illuminated is formed on an upper end edge of the light distribution region P so as to extend in a horizontal direction, and the boundary line CL between light and dark is formed in the vicinity of the H line (for example, a downward angle of (0.57°). Here, the light distribution pattern P formed by the lighting fixture 1 for a vehicle of this embodiment is defined as a portion of the light distribution pattern illustrated in FIG. 2 (for example, any one of the regions P1 to P4). Incidentally, such a configuration can be adopted in which a plurality of lighting fixtures configured in the same manner as the lighting fixture 1 for a vehicle of this embodiment are arranged in a predetermined direction such as a tandem direction or a lateral direction, so that all of the lighting fixtures form the light distribution pattern illustrated in FIG. 2.

Now, when an optical design of the above lighting fixture 1 for a vehicle is conducted, first of all, regarding white light beams emitted in respective directions from the light emitting face 30A of the LED light source 30, a positional relationship between the LED light source 30 and the lens body 10 and a targeted illumination direction of the respective white light beams (targeted emitting directions when white light beams are emitted from the lens body 10) is determined such that the light distribution pattern illustrated in FIG. 2 is formed. Then, the shapes of the incident face 12, the reflecting face 16, and the exit face 18 of the lens body 10 are set such that respective white light beams emitted in the respective directions from the light emitting face 30A are coincident with targeted emitting directions. In this embodiment, the reflecting face 16 of the paraboloid of revolution type is set such that a light emitting point 30B of the light emitting face 30A positioned at a rearmost end regarding the longitudinal direction of the vehicle is projected on the boundary line CL between light and dark in an expanded manner so that the cutoff line is formed. This is because when the rearmost end is set at the boundary line CL between light and dark, an emitted light from a forefront end of the light emitting face 30A is oriented in a more downward direction than the boundary line CL between light and dark, and a glare light oriented in a more upward direction than the H line does not occur and/or can be prevented.

At this time, regarding a refraction angle of the white light beam to an incident angle on the incident face 12 or the exit face 18, a refraction index corresponding to a material of the lens body 10 is used, and when the refraction index varies according to the wavelength of light, a refraction index to a specific reference wavelength (hereinafter, called reference refraction index) is approximately-used as a fixed refraction index in the whole wavelength region of the white light beams (a visible light region). In this embodiment, assuming a fixed reference refraction index to the whole wavelength region of the white light beams using a green wavelength which is a substantially central wavelength in a wavelength region of the white light beams as the reference wavelength and the refraction index of the green wavelength as the reference refraction index, the optical design of the shapes of the incident face 12, the reflecting face 16, and the exit face 18 of the lens body 10 or the like is performed such that the light distribution pattern such as illustrated in FIG. 2 is obtained.

Figure 3:
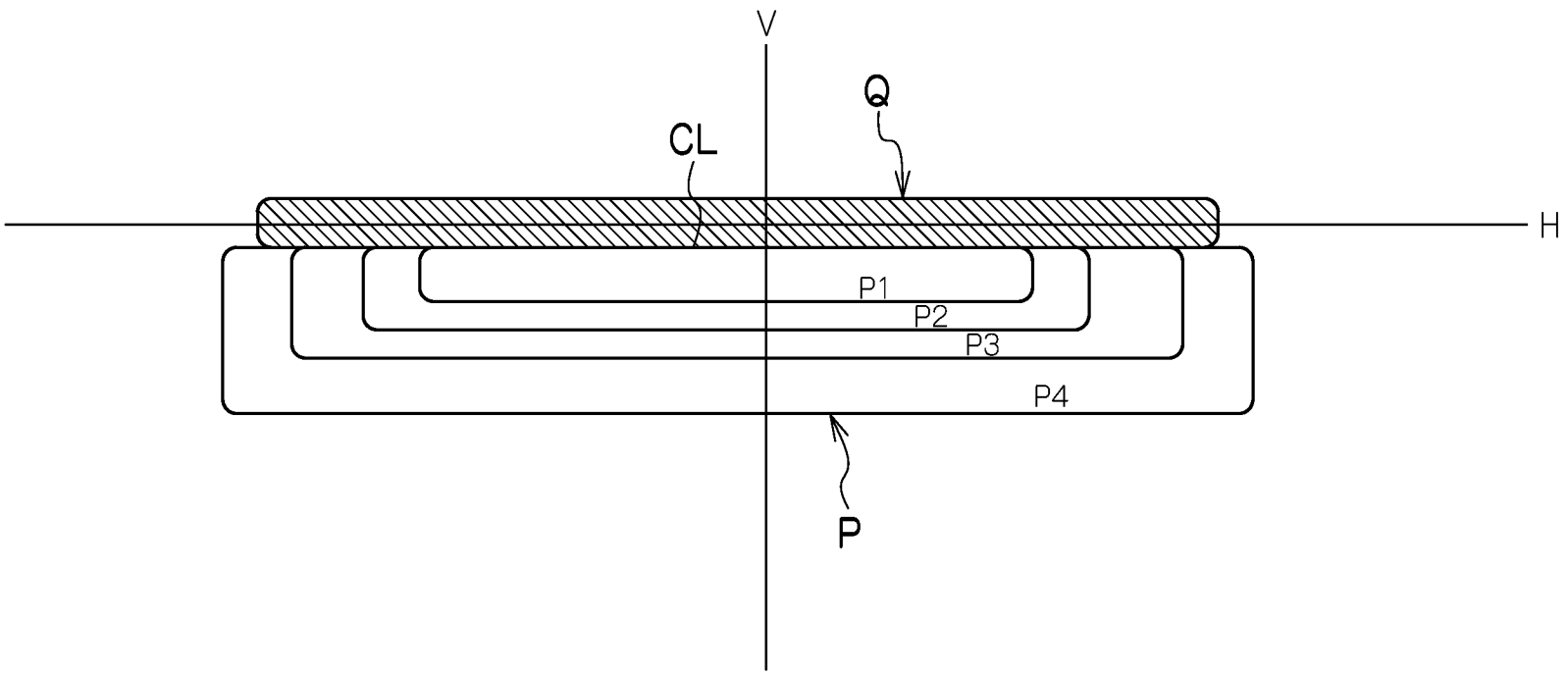
FIG. 3 is a diagram for explaining chromatic aberration on a boundary line between light and dark which can be generated by the lighting fixture for a vehicle illustrated in FIG. 1.

On the other hand, when the lens body 10 is formed of a transparent resin material like this embodiment, a difference in refraction index between respective wavelengths of light is larger than that of a glass lens made of inorganic material. When the lens body 10 is formed of a polycarbonate material especially excellent in transparency, heat resistance, and weather resistance, the polycarbonate material is large in refraction index between respective wavelengths of light and is large in chromatic dispersion, so that when the optical design is performed such that a light distribution pattern such as illustrated in FIG. 2 is obtained assuming a fixed reference refraction index to a whole wavelength region of the white light beams using the refraction index of the green wavelength as the reference refraction index like the above, a drawback may occur in which an unintended illumination region Q where color separation has occurred due to chromatic dispersion is formed above the angle position of the boundary line CL between light and dark as illustrated in FIG. 3. Here, the chromatic dispersion means dispersion of light and means a phenomenon where, when light enters a lens or the like, a refraction index varies according to the wavelength of the light.

That is, the above lens body 10 basically forms a light distribution pattern (or a portion of the light distribution pattern) as illustrated in FIG. 2 by projecting the light emitting face 30A of the LED light source 30 in an expanded state. Therefore, when the optical design is performed such that the light distribution pattern such as illustrated in FIG. 2 can be obtained assuming a fixed reference refraction index to the whole wavelength region of the white light beams and without considering the chromatic dispersion of the lens body 10, the positional relationship between the light emitting face 30A of the LED light source 30 and the lens body 10 is determined such that the light emitting point 30B of the light emitting face 30A which is the rearmost end regarding the longitudinal direction of the vehicle is positioned at a focus of the whole lens body 10. Incidentally, the focus of the whole lens body 10 means a focus position which has been adjusted considering influence due to refraction caused by the incident face 12 regarding the focus position of the reflecting face 16 of the paraboloid of revolution type. At this time, white light beams emitted from the light emitting point 30B in respective directions are emitted as light beams substantially parallel to the angle direction of the boundary line CL between light and dark which is a design target. Design is performed such that white light beams emitted from respective points on the light emitting face 30A which are positioned on a side ahead of the light emitting point 30B in the longitudinal direction of the vehicle are emitted within an angle range below the boundary line CL between light and dark which is the design target.

At this time, when the chromatic dispersion of the lens body 10 is considered, white light beams, which pass through optical paths where light is neither refracted on the incident face 12 nor on the exit face 18, of the white light beams emitted from the light emitting point 30B are emitted in then angle direction of the boundary line CL between light and dark which is the design target. On the other hand, regarding light beams which pass through optical paths where light is refracted on the incident face 12 or on the exit face 18, light beams having wavelengths other than the light beam with a green wavelength (green light beam) used as the reference refraction index, namely, red or blue light beams on the side of wavelengths longer than or shorter than the green wavelength are separated in different directions from the direction of the green light beam on a face at which refraction is caused by the lens body 10 because actual refraction indexes of the wavelengths of the red light beam and the blue light beam are different from the reference refraction index. As a result, portions of the red and blue light beams are emitted in a more upward angle direction than the boundary line CL between light and dark which is the design target so that chromatic aberration (color smear) is caused above the boundary line CL between light and dark to form an unintended illumination region Q as illustrated in FIG. 3 above the boundary line CL between light and dark.

In view of these circumstances, in this embodiment, regarding the basic configuration of the lighting fixture 1 for a vehicle designed assuming the fixed reference refraction index to the whole wavelength region of the white light beams like the above and without considering the chromatic dispersion, namely, the positional relationship between the LED light source 30 and the lens body 10, the configuration of the lens body 10, or the like (the shapes of the incident face 12, the reflecting face 16 and the exit face 18, or the like), adjustment (correction) to the shapes of the incident face 12, the reflecting face 16, and the exit face 18 of the lens body 10 is performed such that a chromatic aberration (an unintended illumination region Q) does not occur on the upper side of the boundary line CL between light and dark, considering the chromatic dispersion (a difference between respective wavelengths) about white light beams emitted from the light emitting point 30B on the light emitting face 30A as described below.

Incidentally, the polycarbonate material has such a characteristic that the refraction index of the polycarbonate material becomes smaller as the wavelength becomes longer in a range of about 380 to 780 nm which is the wavelength region of white light beams (the wavelength region of a visible light). For example, the refraction index of the polycarbonate material to the blue wavelength of 435.8 nm is 1.6115, the refraction index of the polycarbonate material to the green wavelength of 546.1 nm is 1.5855, and the refraction index of the polycarbonate material to the blue wavelength of 706.5 nm is 1.576. At a designing time for the basis of shapes of the incident face 12, the reflecting face 16, and the exit face 18 of the lens body 10, for example, green light (wavelength of 546.1 nm) is used as the light with the reference wavelength, and the reference refraction index is set to 1.5855. Further, it is assumed that adjustment to the basic shapes of the incident face 12, the reflecting face 16, and the exit face 18 of the lens body 10 is performed such that the longest wavelength is set, for example, as the above wavelength (706.5 nm) of the red light and the shortest wavelength is set, for example, as the above wavelength (435.8 nm) of the blue light within the wavelength range of light to be considered regarding the problem of the chromatic dispersion of the lens body 10. In the following, light described by designating the colors of the light, like the green light beam, the red light beam, and the blue light beam illustrate light with the wavelengths listed above. However, values of the respective wavelengths illustrated specifically can be changed properly.

Further, in this embodiment, adjustment to the basic shapes of the incident face 12, the reflecting face 16, and the exit face 18 of the lens body 10 has been performed by adjustment of only the reflecting face 12. That is, the respective shapes of the incident face 16 and the exit face 18 have been fixed to face shapes (flat faces) when designing has been performed such that the light distribution pattern illustrated in FIG. 2 is obtained assuming the reference refraction index, and, for example, adjustment to the paraboloid of revolution type obtained as the basic shape is performed regarding the reflecting face 16.

Further, the exit face 18 of the lens body 10 of the embodiment is formed by a flat face extending in the vertical direction, as described above. Because light reflected from the reflecting face 16 to the vicinity of the boundary line CL between light and dark is emitted in a substantially horizontal direction, the refraction caused by the exit face 18 is small, where the magnitude of the chromatic dispersion also becomes small. Therefore, for simplification of explanation, it is assumed that the chromatic dispersion and the color separation do not occur by the exit face 18, and it is also assumed that the direction of the light beam emitted from the exit face 18 is equal to the direction of the light beam reflected by the reflecting face 16.

The shape adjustment of the lens body 10 will be described below. The lens body 10 illustrated in FIG. 1 is obtained by applying adjustment (correction) to the shape of the reflecting face 16 of the lens body 10 considering the chromatic dispersion (a difference in refraction index between the respective wavelengths) such that an unintended illumination region Q does not occur on the upper side of the boundary line CL between light and dark, and optical paths at the reference refraction index (optical paths when the refraction index is a fixed basic refraction index within the whole wavelength region of the white light beams) of a white light beam X1 entering the incident face 12 perpendicularly to the incident face 12 (an entering angle (0°) and of white light beams X2 and X3 entering the incident face 12 obliquely on the front side of the vehicle and the rear side of the vehicle regarding the white light beam X1, of white light beams emitted from the light emitting point 30B positioned at the rearmost end of the LED light source 30 are illustrated with solid lines in FIG. 1. As illustrated in FIG. 1, after the respective white light beams X1, X2, and X3 emitted from the light emitting point 30B on the light source 30 advance into the lens body 10 from the incident face 12 to be reflected by the reflecting face 16, the light beams X1, X2, and X3 are emitted from the exit face 18 to the outside of the lens body 10. In FIG. 1, optical paths corresponding to the white light beams X1, X2, and X3 obtained by assuming a fixed refraction index to the whole wavelength region of the white light beams without considering the chromatic dispersion are described as a dashed-dotted line as optical paths CLD1, CLD2 and CLD3. It is assumed that the CLD1 is the same optical path as the X1 and the CLD2 and CLD3 emit light beams parallel to the CLD1 from the exit face 18 outside. The optical paths CLD1, CLD2 and CLD3 can be obtained by forming, as the reflecting face 16, a reflecting face of paraboloid of revolution having a position of the light emitting point 30B (strictly speaking, a position located slightly in a left lower direction on the figure from 30B considering refraction caused by the incident face 12) as a focus. This shape is defined as the basic shape. Incidentally, the optical paths CLD1, CLD2 and CLD3 illustrated by the dashed-dotted line represent optical paths for emitting the white light beams X1, X2, and X3 from the exit face 18 in the angle direction of the boundary line CL between light and dark which is the design target, and since the light beam emitted in a direction of the vicinity of the boundary line CL between light and dark is not refracted on the exit face 18, as described above, the optical paths CLD1, CLD2, and CLD 3 are illustrated as straight lines from the position of the reflecting face 16 to the outside of the lens body 10 via the exit face 18.

On the other hand, in the lens body 10 of this embodiment, the shape of the reflecting face 16 is set considering the chromatic dispersion. That is, regarding the white light beam X1 which enters the incident face 12 perpendicularly with respect to the incident face 12 and which does not cause refraction on the incident face 12 and the exit face 18 of the lens body 10, a target emitting direction is set in the angle direction of the boundary line CL between light and dark which is the design target without performing modification from the above. As illustrated in FIG. 1, formation is performed such that the shape (a position and an inclination) of the reflecting face 16 at a position T1 coincides with the basic shape in such a manner that the white light beam X1 entering the position T1 on the reflecting face 16 is reflected in the angle direction of the boundary line CL between light and dark along the optical path CLD1. Incidentally, the angle of the incident face 12 is set such that the position T1 on the reflecting face 16 at which the white light beam X1 which does not cause refraction on the incident face 12 is reflected is at a substantially central position of the reflecting face 16 within a vertical range of the reflecting face 16. Thereby, it is considered that magnitudes of incident angles (refraction angles) on the incident face 12 of all light beams reflected by the reflecting face 16 are as small as possible, so that occurrence of chromatic dispersion is reduced. That is, the position T1 is a reflecting portion of a non-refraction optical path where refraction does not occur on the incident face 12 and coincides with the above-described basic shape.

On the other hand, regarding the white light beams (the white light beams X2 and X3) entering the incident face 12 at positions nearer the front side of the vehicle or the rear side of the vehicle than the white light beam X1 and causing refraction on the incident face 12, target illumination directions are set in a more downward angle direction than the boundary line CL between light and dark according to magnitudes of the chromatic dispersion (color separation) caused by refractions of the white light beams. When a fixed reference refraction index is assumed to the whole wavelength region of the white light beams, as illustrated in FIG. 1, the shape of the reflecting face 16 is designed such that irradiations (reflections) of the white light beams X2 and X3 (namely, the green light beams) which have entered at the positions T2 and T3 positioned above and below the position T1 on the reflecting face 16 are performed in a more downward angle direction than the angle direction of the boundary line CL between light and dark (the optical paths CLD2 and CLD3).

Incidentally, as the method for designing the reflecting face 16 of this embodiment by correcting the reflecting face having the basic shape, for example, it is assumed that using the position T1 where correction is not performed to the reflecting face having the basic shape as a reference point, points on the reflecting face positioned above the reference point are sequentially set as correction points. At a certain correction point, correction is made such that the inclination of the reflecting face 16 reaches an inclination so as to reflect the white light beam which has entered the certain correction point in a target illumination direction corrected, and the positions and the inclinations of the respective points on the whole reflecting face positioned above the correction point are corrected by adding rotation corresponding to the correction of the inclination to a whole portion of the reflecting face positioned above the correction point without changing the whole shape of the reflecting face. Thereafter, new correction points are set on the corrected reflecting face, and the same operation as the above is repeated. Further, such a method in which similar operation as that described with respect to the above operation is repeated regarding the portion of the reflecting face positioned below the position T1 is proposed. However, the method for designing the reflecting face 16 of this embodiment is not limited to this method.

Here, when the shape of the reflecting face 16 is designed considering the chromatic dispersion like the lens body 10 of the embodiment, how irradiations of the white light beams X1, X2, and X3 emitted from the light emitting point 30B of the LED light source 30 are actually performed through the lens body 10 will be specifically described.

First of all, since the white light beam X1 entering the incident face 12 perpendicularly to the incident face 12 is not refracted on the incident face 12, the white light beam X1 advances in the lens body 10 as it is without causing chromatic dispersion (color separation) to enter the position T1 on the reflecting face 16. Then, the white light beam X1 which has entered the reflecting face 16 is reflected in a direction extending along the optical path CLD1 and irradiation of the white light beam X1 is performed in the angle direction of the boundary line CL between light and dark which is the design target (emitted from the exit face 18). The optical paths X1, X2, and X3 of the white light beams illustrated in FIG. 1 are optical paths when it is assumed that a fixed reference refraction index is applied to the whole wavelength region of the white light beams, where the reference refraction index is the refraction index of a green light beam. Therefore, regardless of presence/absence of refraction, a green light beam G1 contained in the white light beam X1 passes through the same optical path as the white light beam X1 illustrated in FIG. 1 to be emitted in the angle direction of the boundary line CL between light and dark which is the design target. Further, since a light beam such as a red or blue light beam contained in the white light beam X1 other than the green wavelength does not cause refraction on the incident face 12 (and the exit face 18) without causing color separation, the light beam passes through the same optical path as the white light beam X1 to be emitted in the angle direction of the boundary line CL between light and dark which is the design target. Accordingly, the white light beam X1 emitted from the light emitting point 30B and entering the incident face 12 perpendicularly to the incident face 12 is emitted, while its color remains in white, in the angle direction of the boundary line CL between light and dark which is the design target, so that the white light beam X1 forms a white boundary line CL between light and dark.

On the other hand, when the white light beam X2 entering the incident face 12 obliquely from a location nearer the front side of the vehicle enters the incident face 12, the white light beam X2 causes refraction and causes color separation within the lens body 10 due to chromatic dispersion. At this time, a green light beam G2 contained in the white light beam X2 advances in the same optical path as the white light beam X2 when the fixed reference refraction index is assumed to enter the position T2 on the reflecting face 16 within the lens body 10. Then, it is reflected in a more downward angle direction than the optical path CLD2 by the reflecting face 16, and it is emitted in a more downward angle direction than the angle direction of the boundary line CL between light and dark which is the design target.

On the other hand, since a red light beam R2 (a dotted line) contained in the white light beam X2 has a refraction index smaller than the reference refraction index (the refraction index of the green wavelength), the red light beam R2 is refracted on the incident face 12 at a refraction angle smaller than that of the green light beam G2, and advances in an optical path having an angle direction positioned nearer the front side of the vehicle than the optical path of the white light beam X2 (the optical path of the green light beam G2) to enter the vicinity of (above) the position T2 on the reflecting face 16. Then, since the red light beam R2 becomes larger in an incident angle to the reflecting face 16 than the white light beam X2 (the green light beam G2), the red light beam R2 is reflected in a more upward angle direction than the white light beam X2 (the green light beam G2). At this time, considering the reflection magnitude of an upward angle direction of the red light beam R2 relative to the white light beam X2 (the green light beam G2), the target emitting direction of the white light beam X2 (the green light beam G2) is set and the shape of the reflecting face 16 is set such that the red light beam R2 is not emitted in a more upward angle direction than the boundary line CL between light and dark which is the design target, so that the red light beam R2 is reflected on the reflecting face 16 in an angle direction substantially extending along the optical path CLD2 or in a more downward angle direction than the optical path CLD2. Thereby, the red light beam R2 is emitted from the exit face 18 so as not to be oriented in a more upward angle direction than the boundary line CL between light and dark which is the design target.

Incidentally, a blue light beam (not illustrated) contained in the white light beam X2 is separated on the incident face 12 to pass through an optical path different from the white light beam X2 (the green light beam G2) illustrated in FIG. 1. However, since the blue light beam is emitted from the exit face 18 in a more downward angle direction than the white light beam X2 (the green light beam G2) in contradiction to the red light beam R2, when the red light beam R2 is emitted in an angle direction in which the red light beam R2 is not oriented in a more upward angle direction than the boundary line CL between light and dark which is the design target, the blue light beam is emitted in an angle direction in which the blue light beam is not oriented in a more upward angle direction than the boundary line CL between light and dark which is the design target.

Further, when the white light beam X3 entering the incident face 12 obliquely from the rear side of the vehicle enters the incident face 12, the white light beam X3 causes refraction and causes color separation within the lens body 10 due to chromatic dispersion. At this time, a green light beam G3 contained in the white light beam X3 advances in the same optical path as the white light beam X3 when a fixed reference refraction index is assumed in the lens body 10 to enter the position T3 on the reflecting face 16. Then, the green light beam G3 is reflected in a more downward angle direction than the optical path CLD3 by the reflecting face 16 so that the green light beam G3 is emitted in a more downward angle direction than the angle direction of the boundary line CL between light and dark which is the design target.

On the other hand, since a blue light beam B3 (a dotted line) contained in the white light beam X3 has a larger refraction index than the reference refraction index (the refraction index of the green wavelength), the blue light beam B3 is refracted on the incident face 12 at a larger refraction angle than that of the green light beam G3 and advances in an optical path having an angle direction positioned nearer the front side of the vehicle than the optical path of the white light beam X3 (the optical path of the green light beam G3) to enter the vicinity of (above) the position T3 on the reflecting face 16. Then, since the blue light beam B3 is larger in incident angle to the reflecting face 16 than the white light beam X3 (the green light beam G3), the blue light beam B3 is reflected at a more upward angle direction than the white light beam X3 (the green light beam G3). At this time, considering the reflection magnitude of an upward angle direction of the blue light beam B3 relative to the white light beam X3 (the green light beam G3), the target emitting direction of the white light beam X3 (the green light beam G3) is set and the shape of the reflecting face 16 is set such that the blue light beam B3 is not emitted in a more upward angle direction than the boundary line CL between light and dark which is the design target. Therefore, the blue light beam B3 is reflected on the reflecting face 16 in an angle direction substantially extending along the optical path CLD3 or in a more downward angle direction than the optical path CLD3. Thereby, the blue light beam B3 is emitted from the exit face 18 so as not to be oriented in a more upward angle direction than the boundary line CL between light and dark which is the design target.

Incidentally, a red light beam (not illustrated) contained in the white light beam X3 is separated on the incident face 12 to pass through an optical path different from the white light beam X3 (the green light beam G3) illustrated in FIG. 1. Then, the red light beam is emitted from the exit face 18 in a more downward angle direction than the white light beam X3 (the green light beam G3) in contradiction to the blue light beam B3. Therefore, when the blue light beam B3 is emitted in an angle direction in which the blue light beam B3 is not oriented in a more upward angle direction than the boundary line CL between light and dark which is the design target, the red light beam is also emitted in an angle direction in which the red light beam is not oriented in a more upward angle direction than the boundary line CL between light and dark which is the design target.

As described above, according to the lighting fixture 1 for a vehicle of the embodiment, regarding a light beam such as the white light beam X1, which passes through an optical path where the refraction does not occur and the chromatic dispersion (color separation) does not occur in the lens body 10, of the white light beams emitted in the respective directions from the light emitting point 30B of the LED light source 30, the light beam is emitted in the angle direction of the boundary line CL between light and dark, so that a clear boundary line CL between light and dark is formed by the white light. Further, the chromaticity of the boundary line CL between light and dark is held within a range of the white by formation of the boundary line CL between light and dark by the white light beam X1.

On the other hand, regarding the white light beams X2 and X3 passing through the optical paths where the refraction occurs and the chromatic dispersion occurs, the target emitting direction (the emitting direction of the green light beam) when a fixed reference refraction index is assumed over the whole wavelength region of the white light beams is set in a more downward angle direction than the boundary line CL between light and dark. Thereby, the red or blue light beam which is emitted in a more upward angle direction than the green light beam due to chromatic dispersion is emitted in a more downward angle direction than the boundary line CL between light and dark. That is, light within a wavelength region which has been subjected to color separation is emitted within the light distribution pattern positioned below the boundary line CL between light and dark. The light is color-mixed with illumination light from positions other than the light emitting point 30B or the like within the light distribution. Accordingly, such a drawback in which an unintended illumination region Q is generated on the upper side of the boundary line CL between light and dark due to chromatic dispersion is prevented.

Further, when a boundary between light and dark is formed using an LED light source using a wavelength-converting material as the light source, it is also suitable from a viewpoint of an energy use efficiency that light flux emitted from the LED chip is utilized effectively as far as possible to form a boundary between light and dark without being blocked. Therefore, it is possible that an end portion of the LED light source is utilized as a boundary between light and dark, especially, a boundary line CL between light and dark in the vicinity of the H line of a headlamp for a passing beam. In this case, the LED light source is provided with a wavelength-converting material layer extending up to an LED end portion, as illustrated in FIGS. 6A and 6B, a color unevenness occurs at an LED light source end portion more easily than at a central portion of the LED light source. This involves a potential problem in that the color unevenness of the LED light source is projected on the boundary line CL between light and dark as it is when the LED light source is projected by the lens body in a magnified manner. In this embodiment, as described above, since the lens body manufactured considering the chromatic dispersion regarding the boundary line CL between light and dark is used, even if color unevenness has occurred at an end portion of the LED light source, it becomes possible to reduce the color unevenness.

Figure 4:
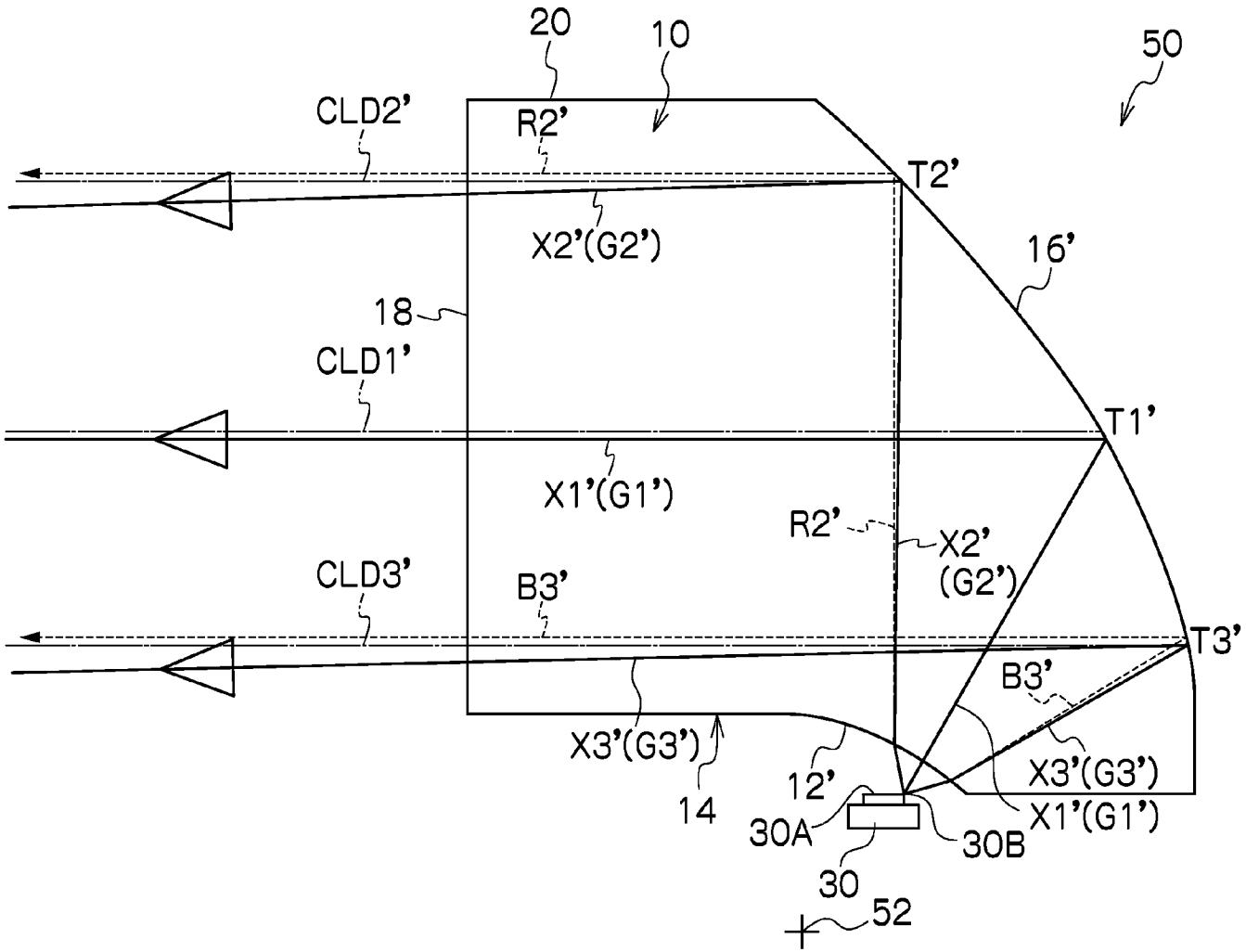
FIG. 4 is a vertical-sectional view illustrating a configuration of a second embodiment of a lighting fixture for a vehicle according to the presently disclosed subject matter.

FIG. 4 is a vertical-sectional view illustrating a configuration of a second embodiment of a lighting fixture for a vehicle according to the presently disclosed subject matter. Elements identical with or similar to those of the lighting fixture 1 for a vehicle of the first embodiment illustrated in FIG. 1 are attached with identical or prime reference signs. A lighting fixture 50 for a vehicle illustrated in FIG. 4 is different in shape of an incident face 12' from the lighting fixture 1 for a vehicle illustrated in FIG. 1. The incident face 12' of the lighting fixture for a vehicle 50 illustrated in FIG. 4 is not formed in a flat face but a concave face. The other constituent elements of the lighting fixture 50 for a vehicle illustrated in FIG. 4 are constituted in the same manner as those in the lighting fixture 1 for a vehicle of the first embodiment, and the shape of a reflecting face 16' of the lens body 10 is formed so as to form the light distribution pattern illustrated in FIG. 2.

The incident face 12' is, for example, formed in an arc shape having a center 52 at a position separated from the incident face 12' farther than the light emitting point 30B of the LED light source 30 in vertical-sectional view illustrated in FIG. 4 (an arc which is larger in radius of curvature than an arc having the light emitting point 30B of the LED light source 30 as a center of the arc). Further, the incident face 12' is formed of such an arc concave face that the center 52 of the arc of the incident face 12' is positioned on a straight line passing through the light emitting point 30B and the position T1' near the center of the reflecting face 16'. Therefore, incident angles of light beams emitted from the light emitting point 30B in respective directions when the light beams enter the incident face 12' are wholly smaller than that of the case of the lighting fixture 1 for a vehicle of the first embodiment, and chromatic dispersion on the incident face 12' due to refraction becomes smaller.

The shape of the reflecting face 16' is designed considering chromatic dispersion occurring in the lens body 10. Regarding a white light beam X1', which enters the incident face 12' perpendicularly to the incident face 12' and does not cause refraction on the incident face 12' and the exit face 18 of the lens body 10, of white light beams emitted in the respective directions from the light emitting point 30B, a target emitting direction is set in an angle direction of the boundary line CL between light and dark. As illustrated in FIG. 4, the shape (a position and an inclination) of the reflecting face 16' at a position T1' is formed such that the white light beam X1' (a green light beam G1') which has entered the position T1' on the reflecting face 16' is reflected in an angle direction of the boundary line CL between light and dark extending along an optical path CLD1'.

On the other hand, regarding white light beams (white light beams X2' and X3') which enter the incident face 12' at positions nearer the front side of the vehicle or the rear side of the vehicle than the white light beam X1' and cause refraction on the incident face 12', target emitting directions are set in a more downward angle direction than the boundary line CL between light and dark according to magnitudes of the chromatic dispersion (color separation) caused by refractions thereof. When a fixed reference refraction index is assumed to the whole wavelength region of the white light beams, the shape of the reflecting face 16' is designed such that the white light beams X2' and X3' (green light beams G2' and G3') which have entered at the positions T2' and T3' positioned above and below the position T1' on the reflecting face 16' are emitted (reflected) in a more downward angle direction than the angle directions (optical paths CLD2' and CLD3') of the boundary line CL between light and dark.

According to this design, since chromatic dispersion on the incident face 12' can be made smaller, the illumination region Q can be more securely prevented from occurring on the upper side of the boundary line CL between light and dark. Further, since occurrence of the illumination region Q can be prevented substantially completely, the downward degree (the magnitude of the downward angle) of the emitting direction of the white light beam (the green light beam) can be made relatively small, so that change to be added to the shape of the reflecting face 16' can be reduced and influence of the other illumination region other than the boundary line CL between light and dark on the light distribution can be reduced.

Incidentally, the incident face 12' may be formed in an elliptic arc in a vertical section instead of the arc, and if the incident face 12' has a concave curved face as viewed from the light emitting point 30B, an effect similar to the above can be obtained. When the shape of the incident face 12' is formed in a spherical face having the light emitting point 30B as a central point of the incident face 12', an incident angle from the light emitting point 30B become 0°, so that refraction does not occur. Therefore, color separation due to the incident angle can be prevented from occurring. In this case, however, unless, corresponding to light entered from the incident face constituted as the spherical face, the reflecting face is largely formed so as to cover the spherical face corresponding to the spherical face, a use efficiency of light lowers. That is, the lens body results in size enlargement. Therefore, the concave curved face can be designed such that the chromatic dispersion becomes small, while a balance between a capturing amount of light emitted from the light emitting face 30A and the size of the reflecting face 16 is considered. The curvature of a portion of the incident face positioned near the reflecting face can be made close to that of a spherical face having the light emitting point 30B as a central point of the spherical face, as illustrated in FIG. 4.

Figure 5:
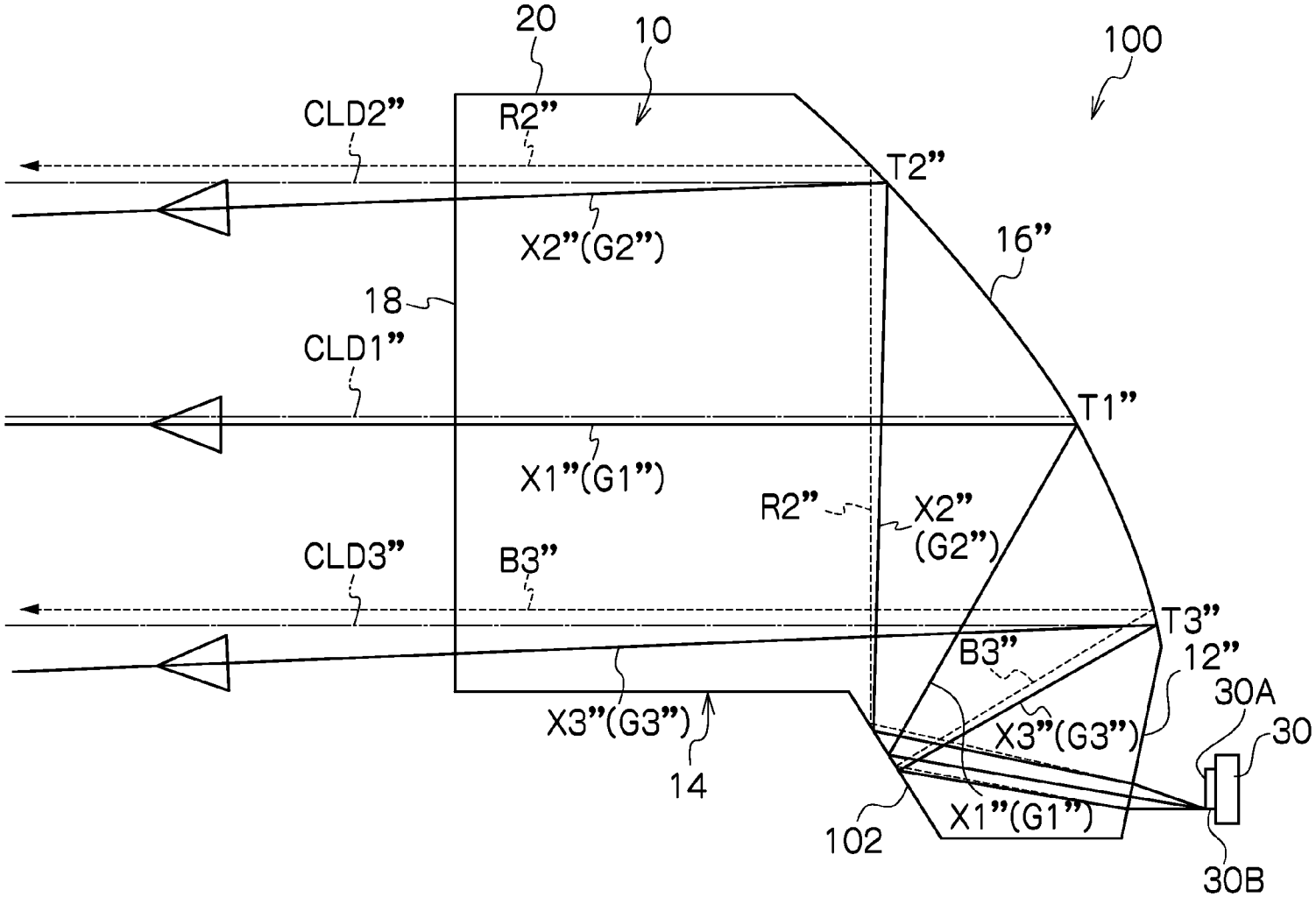
FIG. 5 is a vertical-sectional view illustrating a configuration of a third embodiment of a lighting fixture for a vehicle according to the presently disclosed subject matter.

FIG. 5 is a vertical-sectional view illustrating a configuration of a third embodiment of a lighting fixture for a vehicle according to the presently disclosed subject matter. Elements identical with or similar to those of the lighting fixture for a vehicle of the first embodiment illustrated in FIG. 1 are attached with identical reference signs or double prime reference signs. A lighting fixture 100 for a vehicle illustrated in FIG. 5 is different from the lighting fixture for a vehicle illustrated in FIG. 1 in a configuration where light emitting from the LED light source 30 is guided up to a reflecting face 16" corresponding to the reflecting face 16 illustrated in FIG. 1, where the incident face 12" is formed on a back side (on the rear side of the vehicle) of the lens body 10 and the LED light source 30 is arranged on the back face side of the lens body 10 such that the light emitting face 30A faces the front side of the vehicle.

Further, such a configuration is adopted such that light from the LED light source 30 which has entered the lens body 10 from the incident face 12" enters in the reflecting face 16" after the light is reflected by another reflecting face 102 different from the reflecting face 16" without causing the light to directly enter the reflecting face 16". That is, after the light from the LED light source 30 which has entered the lens body 10 from the incident face 12" is twice reflected within the lens body 10, the light is emitted from the exit face 18. Incidentally, the reflecting face 102 reflecting light in the lens body 10 is formed by performing vapor deposition of aluminum to an outer face portion of the lens body 10 where the reflecting face 102 is formed.

Also in the lighting fixture 100 for a vehicle having such a configuration, like the first embodiment, certain drawbacks can be prevented, such as when the illumination region Q due to chromatic dispersion is generated on the upper side of the boundary line CL between light and dark.

That is, the shape of the reflecting face 16" is designed considering chromatic dispersion occurring in the lens body 10. Regarding a white light beam X1", which enters the incident face 12" perpendicularly to the incident face 12" and does not cause refraction on the incident face 12" and the exit face 18 of the lens body 10, of white light beams emitted in respective directions from the light emitting point 30B, a target emitting direction is set in an angle direction of the boundary line CL between light and dark. As illustrated in FIG. 5, the shape (a position and an inclination) of the reflecting face 16" at the position T1" is formed such that the white light beam X1" (a green light beam G1") which has entered a position T1" on the reflecting face 16" is reflected in an angle direction of the boundary line CL between light and dark extending along an optical path CLD1".

On the other hand, regarding white light beams (white light beams X2" and X3") which enter the incident face 12' from positions at an upper side of the vehicle or lower side of the vehicle as compared to the white light beam X1" and which cause refraction on the incident face 12", target emitting directions are set in a more downward angle direction than the boundary line CL between light and dark according to magnitudes of the chromatic dispersion (color separation) caused by refractions of the white light beams. When a fixed reference refraction index is assumed to the whole wavelength region of the white light beams, the shape of the reflecting face 16" is designed such that the white light beams X2" and X3" (green light beams G2" and G3") which have entered at the positions T2" and T3" positioned above and below the position T1" on the reflecting face 16" are emitted (reflected) in a more downward angle direction than the angle direction of the boundary line CL between light and dark (optical paths CLD2" and CLD3").

According to the above third embodiment, by providing a plurality of reflecting faces (16", 102) reflecting light in the lens body 10, a selection range of the arrangement place of the LED light source 30 can be expanded. That is, by changing the positions of the incident face 12" and the reflecting face 102, it is possible to change the arrangement place of the LED light source 30 to a position different from the position illustrated in FIG. 5. Also, in the aspect where a plurality of reflecting faces is provided, when the shape of the reflecting face 16" is set (corrected from the basic shape) such that an emitting direction of a green light beam (a white light beam when a fixed reference refraction index is assumed) passing through an optical path causing refraction is oriented in a more downward angle direction than the angle direction of the boundary line light and dark CL, the illumination region Q can be prevented from being generated on the upper side of the boundary line light and dark CL.

Incidentally, in the third embodiment, the lens body 10 configured to reflect light which has entered the lens body 10 within the lens body 10 twice to emit the light from the exit face 18 is illustrated, but the illumination region Q can be prevented from occurring on the upper side of the boundary line CL between light and dark even in a lighting fixture for a vehicle using a lens body configured to reflect light which has entered the lens body 10 within the lens body 10 three times or more to emit the light from the exit face 18 in the same manner as the above embodiment.

Figure 8:
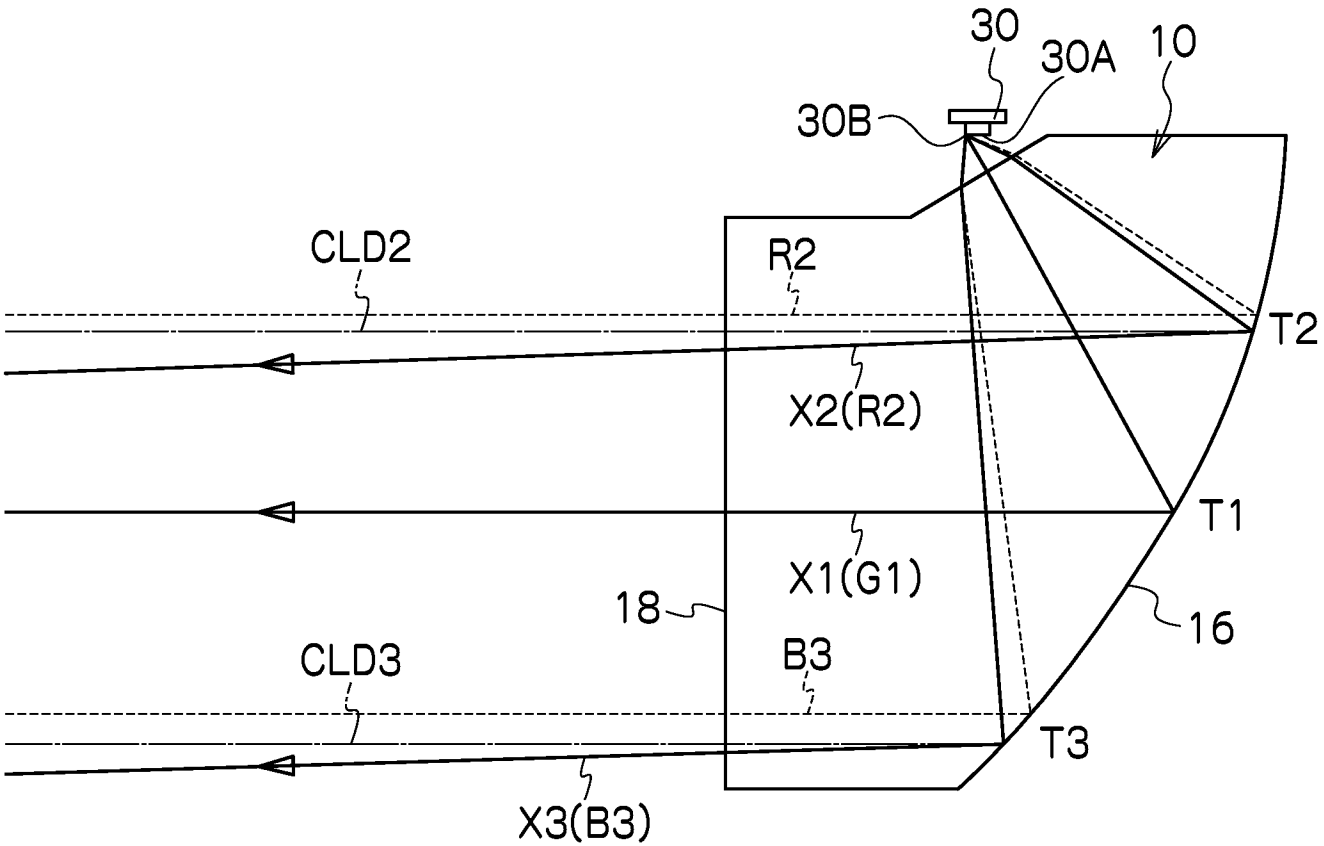
FIG. 8 is a vertical-sectional view illustrating a configuration of another embodiment of a lighting fixture for a vehicle according to principles of the presently disclosed subject matter.

FIG. 8 is a vertical-sectional view illustrating a configuration of another embodiment of a lighting fixture for a vehicle according to principles of the presently disclosed subject matter. A lighting fixture 1 for a vehicle includes a lens body 10 (light guide) and an LED light source 30. In this embodiment, the LED light source 30 is arranged above the lens body 10, i.e., the upper side of the vehicle.

An incident face 12 and an exit face 18 of the lens body 10 can be flat faces, and the exit face 18 can extend in a vertical direction which is perpendicular to the longitudinal direction (the horizontal direction) of the vehicle.

A light emitting point 30B of the LED light source 30 is positioned at the anteriormost side of a light emitting face 30A regarding the longitudinal direction of the vehicle, and is positioned at a focus of the lens body 10. The LED light source 30 may be arranged such that the LED light source 30 of FIG. 8 is rotated 90 degrees in a counterclockwise fashion about the light emitting point 30B.

A white light beam X1 enters the incident face 12 of the lens body 10 perpendicularly with respect to the incident face 12. Regarding the white light beam X1, refraction is not caused on the incident face 12. The shape (a position and an inclination) of the lens body 10 (the reflecting face 16 and the exit face 18) at a position T1 is formed such that the white light beam X1 (a green light beam X1(G1)) which has entered the position T1 is reflected in an angle direction of a boundary line CL between light and dark, or substantially horizontal direction.

White light beams X2 and X3 enter the incident face 12 of the lens body 10 obliquely with respect to the incident face 12 (at an angle other than the perpendicular angle with respect to the incident face 12). The shape of the lens body 10 including the reflecting face 16 and the exit face 18 is designed such that the white light beam X2, or the red light beam R2 in X2(R2) in the white light beam X2 which has entered at the positions T2 positioned above the position T1 is emitted (reflected) in the angle direction of the boundary line CL between light and dark (a dashed-dotted line CLD2 (in the substantially horizontal direction) in FIG. 8), or in a more downward angle direction than the angle directions of the boundary line CL between light and dark. According to this design, the green and blue beams in the white light beam X2 are also reflected in the angle direction of the boundary line CL between light and dark, or in a more downward angle direction than the angle directions of the boundary line CL between light and dark.

Further, the shape of the lens body 10 including the reflecting face 16 and the exit face 18 is designed such that the white light beam X3, or the blue light beam B3 in X3(B3) in the white light beam X3 which has entered at the positions T3 positioned below the position T1 is emitted (reflected) in the angle direction of the boundary line CL between light and dark (a dashed-dotted line CLD3 (in the substantially horizontal direction) in FIG. 8), or in a more downward angle direction than the angle directions of the boundary line CL between light and dark. According to this design, the red and green beams in the white light beam X3 are also reflected in the angle direction of the boundary line CL between light and dark, or in a more downward angle direction than the angle directions of the boundary line CL between light and dark.

The lighting fixtures for a vehicle illustrated in the above embodiments have the lens bodies 10 formed of the polycarbonate material, but even when the lens body 10 is formed of a material (for example, a transparent material such as glass or acrylic) other than the polycarbonate material, if the material is a material causing chromatic dispersion, the disclosed subject matter of the present application can be applied to the lens body 10 like the above embodiments. Thereby, an unintended illumination region Q can be prevented from being generated on the upper side of the boundary line between light and dark regardless of the magnitude of chromatic dispersion which can be generated for each material of the lens body 10.

Further, the lighting fixture for a vehicle according to the presently disclosed subject matter not only prevents generation of an unintended illumination region Q on the upper side of the boundary line between light and dark due to chromatic dispersion in the lens body 10 but also can reduce, in a case where the material of the lens body 10 has a property of birefringence like the polycarbonate material, blur of the boundary line between light and dark occurring due to the birefringence. For example, the polycarbonate material is large in residual stress at a formation time thereof and has a property of birefringence due to high photoelastic coefficient specific to the material, where light beams (light beams refracted on the incident face 12), which enter the incident face 12 (12', 12") obliquely, of light beams emitted from the light emitting point 30B of the LED light source 30 are complexly separated in a plurality of directions. If designing is performed such that the white light beam (the green light beam) when a fixed reference refraction index is assumed is emitted in an angle direction of the boundary line CL between light and dark without considering birefringence to these light beams, the light beams separated due to the birefringence cause blur of the boundary line CL between light and dark.

On the other hand, by designing such that light beams refracted on the incident face 12 (12', 12") are emitted in a more downward angle direction than the boundary line CL between light and dark, like the above embodiments, influence of the light beams on the boundary line CL between light and dark can be reduced. Thereby, occurrence of an unintended illumination region Q due to chromatic dispersion can be prevented and occurrence of blur of the boundary line CL between light and dark due to the birefringence can also be prevented.

Further, in the above embodiments, only the shape of the reflecting face 16 (16') is corrected from the basic shape of the reflecting face 16 (16') such that an emitting direction of a green light beam (a white light beam when a fixed reference refraction index is assumed) passing through an optical path causing refraction is oriented in a more downward angle direction than the angle direction of the boundary line CL between light and dark, but such a configuration can be adopted that by correcting the shape of at least one face (either one or more faces) of the incident face 12 (12'), the reflecting face 16 (16'), and the exit face 18 (18') from the basic shape, such that the green light beam passing through the optical path causing refraction is oriented in a more downward angle direction than the angle direction of the boundary line CL between light and dark.

Further, in the above embodiments, the exit face 18 of the lens body 10 is formed as a flat face and such a condition is adopted that the light beam which is emitted from the reflecting face 16 in the angle direction of the vicinity of the boundary line CL between light and dark which is the design target is not refracted on the exit face 18, but the presently disclosed subject matter can be applied to such a case that the exit face 18 is not a flat face (for example, a concave face or a convex face) and refraction occurs on the exit face 18.

That is, in the presently disclosed subject matter, such a condition is adopted that at least one optical path (non-refraction optical path) of a light beam, which enters both the incident face 12 (12', 12") and the exit face 18 perpendicularly (with respect to the incident face 12 (12', 12") and the exit face 18) and does not cause refraction, of light beams exited from the light emitting point 30B of the LED light source 30 is provided, an emitting direction (an emission direction from the exit face 18) of a green light beam (the white light beam) passing through the at least one optical path (non-refraction optical path) is set in the direction of the boundary line CL between light and dark. Regarding an optical path (a refraction optical path) of a light beam, which is refracted on the incident face 12 (12') or the exit face 18, of the light beams emitted from the light emitting point 30B of the LED light source 30, an emitting direction of a green light beam (a white light beam when a fixed reference refraction index is assumed) is oriented in a more downward angle direction than the angle direction of the boundary line CL between light and dark, so that an unintended illumination region Q is prevented from being generated on the upper side of the boundary line CL between light and dark. At this time, when an emitting direction of a green light beam (a white light beam when a fixed reference refraction index is assumed) is determined to coincide with a direction in which all light positioned on the side of a wavelength longer or on the side of a wavelength shorter than the wavelength of the reference refraction index coincide with the angle direction of the boundary line CL between light and dark or in a more downward direction than the angle direction of the boundary line CL between light and dark. Light beams which are emitted in a more upward angle direction than the boundary line CL between light and dark can be completely eliminated, and occurrence of an unintended illumination region Q can be prevented completely.

Further, it is desirable that the position T1 (T1', T1") of the non-refraction optical path reflecting portion where a light beam passing through the non-refraction optical path is reflected on the reflecting face 16 (16', 16") be positioned substantially at the center of the reflecting face 16 in the vertical direction of the reflecting face 16. However, this position T (T', T") may not necessarily be located at the center.

Further, when the upper side refraction optical path reflecting portion and the lower side refraction optical path reflecting portion which reflect a light beam passing through the refraction optical paths are provided on the reflecting face 16 above and below the non-refraction optical path reflecting portion, as a factor causing an unintended illumination region Q, influence of a light beam reflected by the upper side refraction optical path reflecting portion and passing through the refraction optical path is larger. Therefore, the shape of the upper side refraction optical path reflecting portion may be corrected to the basic shape such that only the emitting direction of the green light beam (the white light beam when a fixed reference refraction index is assumed) is oriented in a more downward angle direction than the angle direction of the boundary line CL between light and dark.

Further, in the above embodiments, the case where the lighting fixture for a vehicle is applied to a headlamp performing irradiation of an illumination light having a light distribution pattern for a low beam has been described, but the presently disclosed subject matter is not limited to the headlamp. For example, the presently disclosed subject matter can not only be applied to the low beam headlamp but also to other kinds of lighting fixtures for a vehicle such as a headlamp for a high beam or a fog lamp. The disclosed subject matter can be applied to other kinds of lighting fixtures for a vehicle for forming a light distribution pattern having a boundary between light and dark at an end edge of the light distribution pattern or for a lighting fixture for a vehicle performing irradiation of an illumination light in a direction of a boundary between light and dark in a portion of the light distribution pattern.

REFERENCE SIGNS LIST

1, 50, 100 . . . lighting fixture for a vehicle,
10 . . . lens body,
12, 12', 12" . . . incident face,
16, 16', 16", 102 . . . reflecting face,
18 . . . exit face,
30 . . . LED light source
30A . . . light emitting face,
30B . . . light emitting point It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A lighting fixture for a vehicle comprising:

a light source configured to emit visible light having a plurality of wavelength components including at least blue, green and red components; and a lens body formed with a chromatically dispersed material, the lens body including an incident face, a reflecting face, and an exit face, the lens body configured such that a light distribution pattern formed by reflecting light from the light source which has entered inside the lens body from the incident face in a predetermined direction by the reflecting face to emit the light outside the lens body forms a boundary line between light and dark, wherein:

the incident face is formed as at least one of a flat face and a concave curved face forming both, a non-refraction optical path where light emitted from a predetermined point of the light source and which enters the incident face does not experience refraction when passing through the incident face, and at least one refraction optical path where light emitted from the end portion of the light source and which enters the incident face experiences refraction when passing through the incident face, the reflecting face, which directly reflects the light incident inside the lens body towards the emission surface, including a non-refraction optical path reflecting portion where light passing through the non-refraction optical path is reflected, a refraction optical path reflecting portion where light passing through the at least one refraction optical path is reflected, and an upper side refraction optical path reflecting portion where light passing through the at least one refraction optical path is reflected positioned on a portion of the reflecting face located on a more upper side of the vehicle than the non-refraction optical path reflecting portion in a vertical section of the lens body, wherein the non-refraction optical path reflecting portion, the refraction optical path reflecting portion and the upper side refraction optical path reflecting portion are located on a common surface of the reflecting face, the upper side refraction optical path reflecting portion is formed such that, light emitted from the light source which is green, and which passes through the non-refraction optical path, is oriented slightly downward relative to a remainder of light emitted outside the lens body, and such that light emitted from the light source which has a visible light color having a refraction index smaller than a refraction index of a green wavelength in the lens body is emitted at least one of toward the boundary line between light and dark of the light distribution pattern constituted by the light passing through the refraction optical path, and inward of the light distribution pattern;

the light source emits white light including red, green, and blue light having light emission sources, the predetermined point is an emission surface at the end portion of the light emission surface, and the light source is positioned such that the beam emitted through the reflection surface and the emission surface after the emission light from the end portion of the light emission surface and the end portion on the opposite side incident the incident face of the lens body, emits lower than the boundary between light and dark.

2. The lighting fixture for a vehicle according to claim 1, wherein:

the reflecting face further includes a lower side refraction optical path reflecting portion positioned on a portion of the reflecting face located on a lower side of the vehicle than the non-refraction optical path reflecting portion in the vertical section of the lens body, and the lower side refraction optical path reflecting portion is formed such that green light emitted from the light source and which passes through the non-refraction optical path is oriented slightly downward relative to a remainder of light emitted outside the lens body, and such that when light emitted from the light source is a visible light color with a refraction index larger than a refraction index of the light with a green wavelength, the lower side refraction optical path reflecting portion is configured to emit light at least one of toward the boundary line between light and dark of the light distribution pattern constituted by the light passing through the refraction optical path and inward of the light distribution pattern.

3. The lighting fixture for a vehicle according to claim 1, wherein the light source is an LED light source containing a light emitting diode element and a wavelength-converting material.

4. The lighting fixture for a vehicle according to claim 1, wherein the lens body is formed of a polycarbonate material.

5. The lighting fixture for a vehicle according to claim 1, wherein light emitted along the refraction optical path and the upper side refraction optical path emits towards the same or lower side of the light distribution pattern formed by light emitted along the non-refraction optical path.

6. The lighting fixture for a vehicle according to claim 1, wherein the refraction optical path where the red wavelength light beam contained in the region of a visible light beam emitted from the light source is emitted after being reflected at the upper side refraction optical path reflection portion, is emitted in a direction not higher than the non-refraction optical path beam where the green wavelength beam emitted from the light source is emitted after being reflected at the non-refraction optical path reflection portion.

7. The lighting fixture for a vehicle according to claim 1, wherein the refraction optical path where the blue wavelength light beam contained in the region of a visible light beam emitted from the light source is emitted after being reflected at the lower side refraction optical path reflection portion positioned on a lower side of the vehicle than the non-refraction optical path reflection portion, emitted in a direction not higher than the non-refraction optical path beam where the green wavelength beam emitted from the light source is emitted after being reflected at the non-refraction optical path reflection portion.

8. A light fixture for a vehicle comprising:

a light source configured to emit visible light having a plurality of wavelength components; and a lens body including an incident face, a reflecting face, and an exit face, the lens body configured such that a light from the light source which has entered inside the lens body from the incident face is reflected in a predetermined direction by the reflecting face to emit the light outside the lens body, wherein:

the light source emits white light including red, green, and blue having light emission surfaces, a green wavelength beam included in the visible light region beam that entered the incident face from the predetermined point of the light emission surface has an upper side refraction optical path, a non-refraction optical path, and a lower side refraction optical path in the order from the upper part of the exit face as optical paths of the beam that reflects at the reflecting face and emits from the exit face, where the non-refraction optical path is an optical path configured so that the light reaches the reflecting face without being refracted at the incident face and is reflected at the reflecting face and exits from the exit face in the direction of the boundary between light and dark of the predetermined light distribution pattern, the upper side refraction optical path and lower side refraction optical path are optical paths configured so that the optical path which passes through the incident face, reaches the reflecting face, and carries on to the exit face will be refracted at the boundary face, amongst the reflection points on the reflection surface, there are a central reflection point (T1), an upper reflection point (T2) which is higher than the central reflection point (T1), and a lower reflection point (T3) which is lower than the central reflection point (T1) where the reflected surface is formed so that a beam which passes through the non-refraction optical path is reflected at the central reflection point (T1), the beam which passes through the upper side refraction optical path is reflected at the upper reflection point (T2) and the beam which passes through the lower side refraction optical path is reflected at the lower reflection point (T3), the lens body has the incident face, the reflecting face, and the exit face having a shape forming a boundary between light and dark by a white light where each of the blue wavelength beam, green wavelength beam, and red wavelength beam included in the visible light region beams that entered the incident face from the predetermined point of the light emitting face are reflected at the central reflection point (T1), and then form the non-refraction optical path that moves towards the boundary between light and dark of the predetermined light distribution pattern from the exit face, the beam that passes through the upper side refraction optical path is a green wavelength beam included in a visible light region beam that entered the incident face from the predetermined point, and light reflected at the upper reflection point (T2) exits from the exit face to emit more downward than the non-refracted optical path, further, in order that the beam included in the visible light region beam that entered the incident face from the predetermined point and the beam apart from the green wavelength that has been color separated by the upper side refraction optical path and the lower side refraction optical path not emit more upper than the direction of the boundary between light and dark, at least one face amongst the incident face, reflecting face, and the exit face of the lens body has a shape that is corrected so that the green wavelength beam that passes through the upper side refraction optical path and the lower side refraction path will exit the exit face in a direction more downward than the boundary between light and dark, the predetermined point is an emission surface at the end portion of the light emission surface, and the light source is positioned such that the beam emitted through the reflection surface and the emission surface after the emission light from the end portion of the light emission surface and the end portion on the opposite side incident the light incident surface of the lens body, emits lower than the boundary between light and dark.

9. The lighting fixture for a vehicle according to claim 8, wherein the incident face is a concave curved face constituting one of an arc, a sectional shape of which has a center of the incident face at a position separated from the end portion of the light source, and an elliptic arc.

10. The lighting fixture for a vehicle according to claim 8, wherein the lens body includes a second reflecting face different from the reflecting face, and the second reflecting face is provided in an optical path where light which has entered from the incident face advances in the lens body to reach the reflecting face.

11. The lighting fixture for a vehicle according to claim 8, wherein the light source is an LED light source containing a light emitting diode element and a wavelength-converting material.

12. The lighting fixture for a vehicle according to claim 8, wherein the lens body is formed of a polycarbonate material.

13. The lighting fixture for a vehicle according to claim 8, wherein the upper side refraction optical path where the red wavelength light beam contained in the region of a visible light beam emitted from the light source is emitted after being reflected at the upper reflection point (T2), is emitted in a direction not higher than the non-refraction optical path beam where the green wavelength beam emitted from the light source is emitted after being reflected at the central reflection point (T1).

14. The lighting fixture for a vehicle according to claim 8, wherein the lower side refraction optical path where the blue wavelength light beam contained in the region of a visible light beam emitted from the light source is emitted after being reflected at the lower reflection point (T3), is emitted in a direction not higher than the non-refraction optical path beam where the green wavelength beam emitted from the light source is emitted after being reflected at the central reflection point (T1).

* * * * *